United States Patent [19]

Pink

[11] 3,942,334

[45] Mar. 9, 1976

[54] DOOR DELAY CLOSING MECHANISM FOR THE ICE CHUTE FROM A POWER DRIVEN ICE DISPENSER IN A FREEZER-REFRIGERATOR

[75] Inventor: John J. Pink, Cedar Rapids, Iowa

[73] Assignee: Amana Refrigeration, Inc., Amana, Iowa

[22] Filed: Jan. 8, 1975

[21] Appl. No.: 539,291

[52] U.S. Cl. ..... 62/266; 16/64; 16/199; 62/344

[51] Int. Cl.[2] ..... F25D 23/02

[58] Field of Search ..... 62/344, 266; 16/83, 140, 16/199, 64; 49/379, 138

[56] References Cited

UNITED STATES PATENTS

| | | | |
|---|---|---|---|
| 885,023 | 4/1908 | Deloe | 16/64 |
| 1,353,219 | 9/1920 | Collins | 16/64 |
| 3,000,043 | 9/1961 | Check | 16/64 |
| 3,537,273 | 11/1970 | Alvarez | 62/344 X |
| 3,699,608 | 10/1972 | Schwarz | 16/64 |

*Primary Examiner*—William E. Wayner
*Assistant Examiner*—William E. Tapolcai
*Attorney, Agent, or Firm*—James C. Nemmers; Haven E. Simmons

[57] ABSTRACT

A power driven ice dispenser in a freezer-refrigerator or the like discharges ice down a chute through the front of the unit. The chute is closed by a spring-loaded door opened by a lever. When the lever is released, an inertia motor delays closing of the door until the chute is emptied of ice.

4 Claims, 4 Drawing Figures

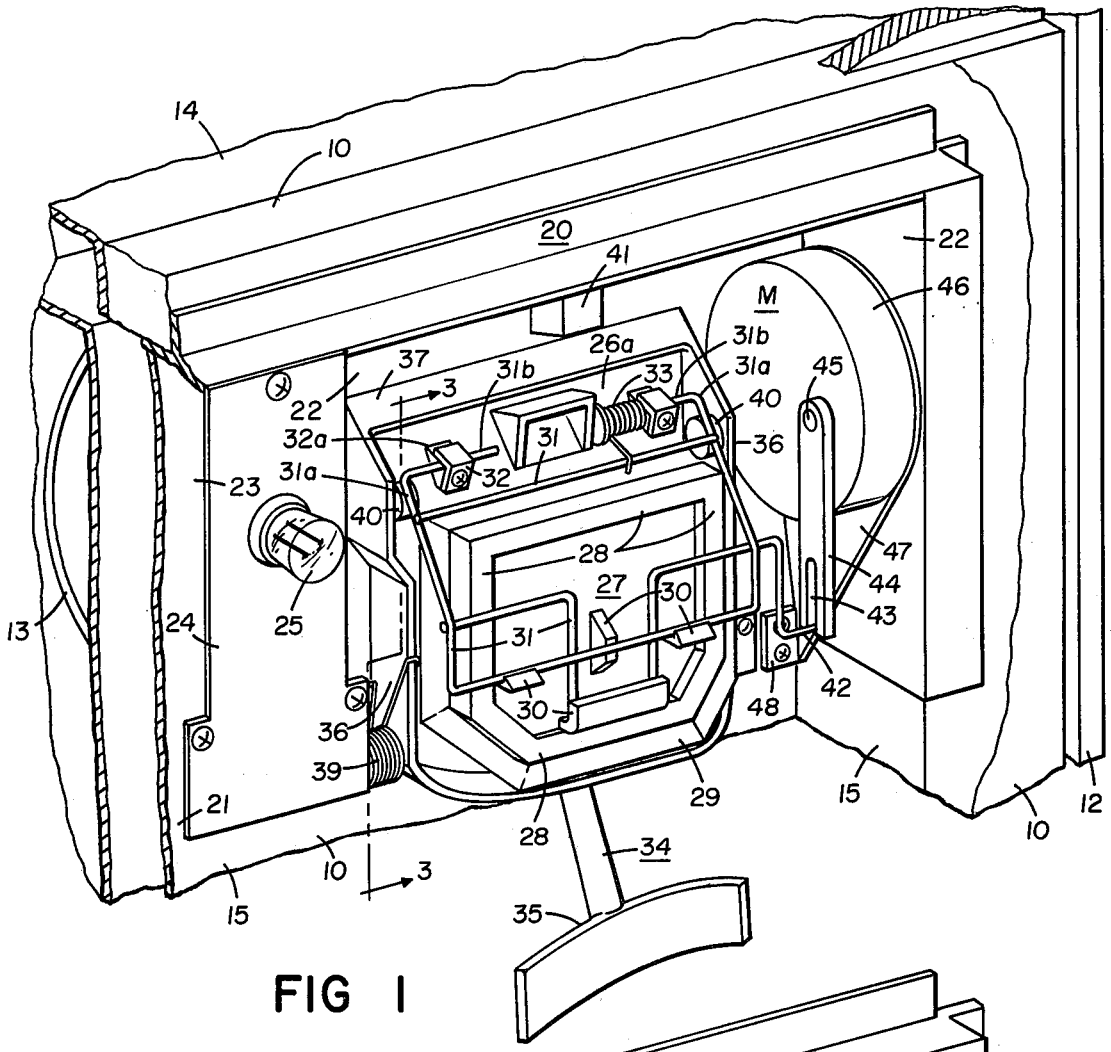
FIG 1
FIG 2
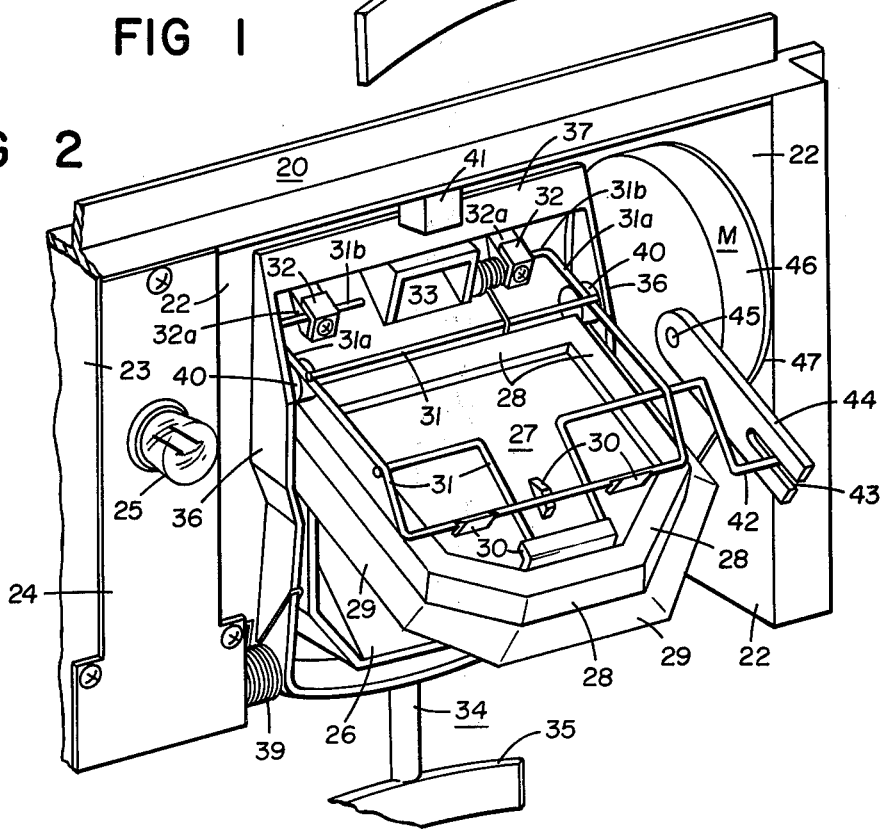

DOOR DELAY CLOSING MECHANISM FOR THE ICE CHUTE FROM A POWER DRIVEN ICE DISPENSER IN A FREEZER-REFRIGERATOR

BACKGROUND OF THE INVENTION

U.S. Pat. No. 3,798,923 to Pink et al. discloses a power driven ice dispenser which discharges ice down a chute through the front of a freezer-refrigerator while the co-pending application of John J. Pink, Ser. No. 433,901, filed Jan. 16, 1974 is directed to an improved version of that dispenser. In both those instances, the lower end of the chute is closed by an outwardly swinging door hinged along its top which is opened when a depending actuating lever is pushed rearwardly, the lever also starting the dispenser at the same time. When the lever is released, the door is closed and the dispenser is shut off. Obviously some ice could be trapped in the chute after the dispenser ceases if closing of the door is not delayed a few seconds to allow the chute to clear. If ice is trapped in the chute or between it and the door, it will slowly melt, making a mess in both instances, and in the case of the latter instance, will also allow warm, moist air up into the dispenser and frost up the chute and other parts.

Various schemes have been used, in other arrangements for dispensing ice down a chute through the front of a freezer-refrigerator, to delay closing of the door in the circumstances explained above. But these tend to be elaborate and piecemeal as well as requiring considerable space. Their reliability may also be suspect. Hence, the primary object of the present invention is the provision of a compact, neat and reliable mechanism to delay closing the door at the lower end of the chute until it has been emptied of all ice from the dispenser after the latter is shut off.

SUMMARY OF THE INVENTION

In the present invention, the door is spring-loaded to its closed position and the activating lever separately spring-loaded to its forward position. When the lever is pushed rearwardly, closing a switch to start the dispenser, at the same time it opens the door against the spring loads of both the door and the lever. When the lever is released, it alone immediately returns to its forward position. The closing of the door, however, is delayed owing of the action of an inertia motor.

The motor comprises a gear train with a very high step up ratio from its input shaft, which is connected to the door, to its output shaft which drives a small fly wheel. A slip clutch, in effect, disconnects the input shaft from the fly wheel when the door is opened so that the motor does not impede door opening. But when the spring load of the door later attempts to close it, the gear train and fly wheel act to resist closing a sufficient time for the chute to clear itself of ice.

BRIEF DESCRIPTION OF THE DRAWINGS

FIG. 1 is a partial isometric view of a fixed panel which closes a portion of the front of the freezer compartment in a typical side by side refrigerator-freezer, certain portions being broken away to show the ice discharge chute, its door when closed, the activating lever, the inertia motor and other parts of the apparatus.

FIG. 2 is similar to FIG. 1, but illustrates the door in its open position.

DETAILED DESCRIPTION OF THE PREFERRED EMBODIMENT

Figures 3, 4:
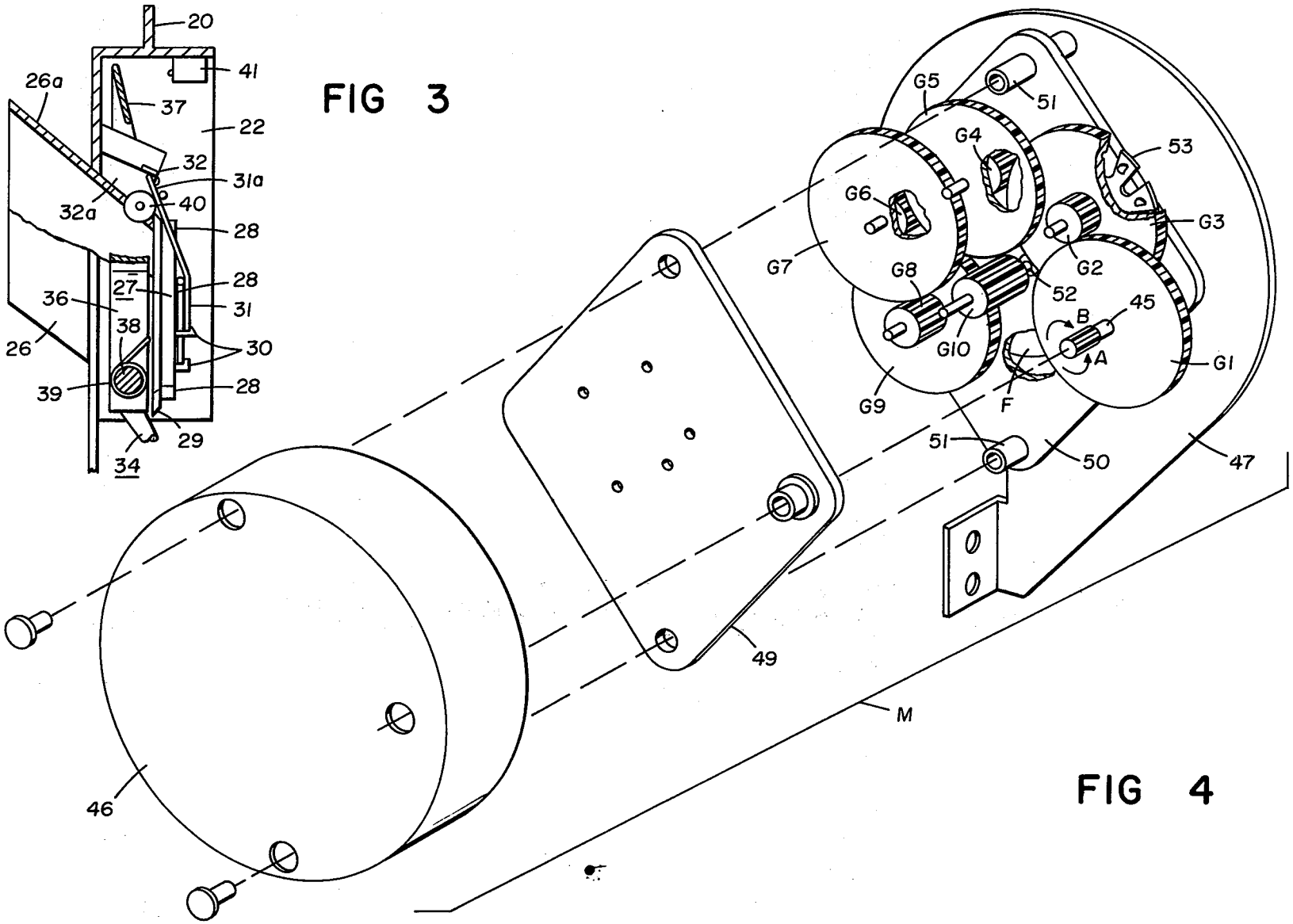
FIG. 3 is a detail view taken along the line 3—3 of FIG. 1.
FIG. 4 is a partially exploded view of the inertia motor itself, certain portions being broken away to illustrate its details.

FIG. 1, 10 depicts the fixed panel or closure, as shown in the aforementioned patent and application, across the front of the freezer compartment of a typical side by side freezer refrigerator, the door closing the portion of freezer compartment above the panel 10 being indicated at 11 and the door for the adjacent refrigerator compartment being indicated at 12. Behind the panel 10 is disposed the power driven ice dispenser 13, which is closed over by a shelf plate 14, in the freezer compartment. Fitting up into a pocket 15 in the upper portion of the panel 10 is a laterally extending, integrally molded mounting assembly 20 having adjacent recesses 21 and 22 separated by a vertical mullion 23 to the front of which is secured a plate 24 carrying a lamp 25 for purposes of illumination. The recess 21 carries the dispensing mechanism (not shown) for chilled water, while recess 22 includes a downwardly leading ice chute 26 (see FIGS. 2 and 3), molded integrally with the assembly 20, which leads from the ice dispenser 13 into the panel pocket 15.

The lower end of the chute 26 is closed by a door 27, over whose edges is fitted and retained an elastomeric gasket 28 flanged at 29 so that the door 27 will seal against the chute 26. The outer face of the door 27 is clipped at 30 to a wire-formed hinge assembly 31 having two rearward legs **31*a* bent toward each other at 31*b*. The ends 31*b* are pivoted beneath retainers 32 screwed to suitable bosses 32*a*, integral with the top wall 26*a* of the chute 26, to provide a hinge for the top of the door 27. The latter is biased toward its closed position by a suitable spring 33 about one of the hinge legs 31*b*. The door is opened by a vertical lever 34 having a depending bar and cross member 35 adapted to be engaged by a container to be filled with ice. The upper portion of the lever 34 is formed as a yoke having side legs 36 straddling the door 27 and connected across their top ends by a bar 37. The outer faces of the lower ends of the yoke legs 36 are provided with trunnions 38 (See FIG. 3) on which the lever is pivoted in the adjacent side walls of the recess 22, a suitable spring 39 biasing the lever 34 to its forward position shown in FIG. 1. Toward the upper ends of the yoke legs 36 and to the inner faces of the latter are attached a pair of cylindrical knobs 40 which engage the rear of the hinge side members 31*a* just below the hinge legs 31*b*. Hence, when the cross member 35 is pushed rearwardly by a container, the door 27 is opened as shown in FIG. 2 against the resistance of both springs 33 and 39. At the same time, the upper cross bar 37 is moved forwardly to close a switch 41 secured to the top of the recess 22 in order to actuate the ice dispenser 13.**

One member of the hinge assembly 31 is laterally extended toward the adjacent side wall of the recess 22 and bent in order to form a crank arm 42. The latter slides in an elongated slot 43 inwardly from the outer end of an arm 44 fixed at its inner end to the input shaft 45 of an inertia motor M. The motor M is enclosed by a cupped housing 46 and secured by a back plate 47 to a boss 48 in the recess 22 between the outer side wall of the latter and the chute 26. Basically, the motor M is an adaptation of a gear train from a timer and comprises a series of step-up gears G1–10 all journalled between two spaced mounting plates 49 and 50 separated by stools 51. The output shaft 52 from the gear G10 passes through the plate 50 and to its outer end is fitted a small flywheel F. The motor M is manufactured by Bristol Saybrook Company of Old Saybrook, Connecticut, and the step-up ratio between its input and output shafts 45 and 52 is 1:3,600. A small slip clutch mechanism 53 is interposed between gears G2 and G3 so that the gears G3-10 and the flywheel F are not driven when the input shaft 45 is rotated in the direction indicated by the arrow A, but are driven when the shaft is rotated in the direction indicated by the arrow B. When the lever 34 is pushed to open the door 27, the crank arm 42 rotates the shaft arm 44 and input shaft 45 in the direction A so that the motor M offers little resistance to the opening of the door 27. When the lever 34 is released, its spring 39 returns it immediately to its normal position independently of the door 27. The motor M, however, since its input shaft is being rotated in direction B and thus all the gears G1-10 and the flywheel F are being driven, delays the closing of the door 27 despite its spring 33 so that all the ice in the chute 26 can escape before the door 27 finally closes.

Through the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. In a freezer-refrigerator unit having a vertical front closure and power driven means for dispensing ice from the interior of the unit to the exterior thereof down an inclined chute through the front closure, the chute having a door closing its lower exterior end and hinged for upward movement for gravitational discharge of ice from the chute when the dispensing means is activated, the combination therewith of a door operating lever movable between door closed and door open positions, switch means operated by the lever to activate de-activate the dispensing means when the lever is in its door open and door closed positions, respectively, the lever being operatively associated with the door to positively open the same when the lever is moved to its door open position, door biasing means normally maintaining the door in its closed position, lever biasing means normally maintaining the lever in its door closed position, the lever when moved to its door open position positively opening the door against both of the door and lever biasing means, and an inertia motor operatively associated with the door effective to delay return of the door to its closed position after return of the lever to its door closed position, said lever biasing means alone returning the lever to its door closed position when the lever is released, the door biasing means thereafter returning the door to its closed position against the action of the inertia motor independently of the return of the lever to its door closed position.

2. The apparatus of claim 1 wherein the motor includes a gear train having input and output shafts, the input shaft being rotated in one direction by the door for drive of the gear train upon movement of the door toward its closed position, the gear train having an overall step-up ratio from the input to the output shafts and a flywheel driven by the output shaft when the latter is rotated as aforesaid.

3. The apparatus of claim 2 wherein the gear train includes means disconnecting drive of the flywheel by the input shaft when the input shaft is rotated in the opposite direction by the door upon its opening movement.

4. The apparatus of claim 3 wherein the disconnecting means comprises a slip clutch.

* * * * *